US005174384A

United States Patent [19]

Herman

[11] Patent Number: 5,174,384

[45] Date of Patent: Dec. 29, 1992

[54] TRANSPORT UNIT FOR FLUID OR SOLID MATERIALS OR DEVICES, AND METHOD

[76] Inventor: Walter W. Herman, 227 Stone Mill Rd., Abingdon, Va. 24210

[21] Appl. No.: 555,506

[22] Filed: Oct. 2, 1990

[51] Int. Cl.[5] ..... A62C 3/00; A62C 39/00

[52] U.S. Cl. ..... 169/70; 169/52; 169/54; 239/271; 89/1.34; 102/504

[58] Field of Search ..... 169/36, 70, 54, 52; 89/1.34, 1.811; 239/271, 272, 289; 102/504; 42/105; 244/3.12; 43/19; 114/230; 441/85; 124/71, 73-75; 273/129 AP

[56] References Cited

U.S. PATENT DOCUMENTS

| | | | |
|---|---|---|---|
| 538,626 | 4/1895 | Schmitt | 102/504 X |
| 1,072,968 | 9/1913 | McCreary | 89/1.34 |
| 1,072,969 | 9/1913 | McCreary | 102/504 |
| 2,469,533 | 5/1949 | Wellcome | 89/1.34 |
| 2,857,005 | 10/1958 | Medlock | 169/70 X |
| 3,065,798 | 11/1962 | Pearson et al. | 169/36 |
| 3,087,427 | 4/1963 | Thorildsson | 102/504 |
| 4,077,349 | 3/1978 | Paul | 89/1.34 X |

FOREIGN PATENT DOCUMENTS

| | | | |
|---|---|---|---|
| 2237417 | 3/1975 | France | 169/24 |
| 8201860 | 6/1982 | World Int. Prop. O. | 441/85 |

*Primary Examiner*—Margaret A. Focarino
*Assistant Examiner*—James M. Kannofsky

[57] ABSTRACT

A transport unit for transporting fire fighting hoses, explosive materials, equipment or other items, the unit having a projectile launcher including a pressure tank providing a compressed gas chamber, and a projectile barrel mounted on the tank in fluid communication with the interior of the tank, a projectile positioned in the barrel, a hose or other line connected at one end to the projectile launcher and adapted for connection at its other end to the projectile, the line being adapted for connection to a pressurized fire fighting or explosive fluid source, or the line being comprised of an explosive material, the compressed gas chamber adapted to provide launching force to the projectile upon actuation of the launcher.

24 Claims, 14 Drawing Sheets

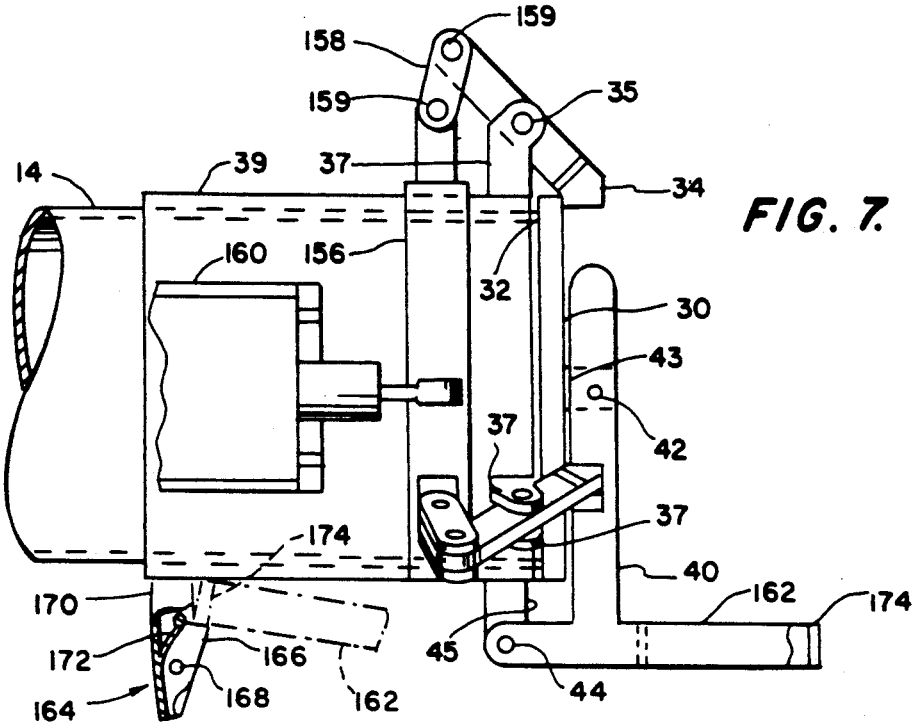
FIG. 7.
FIG. 8.
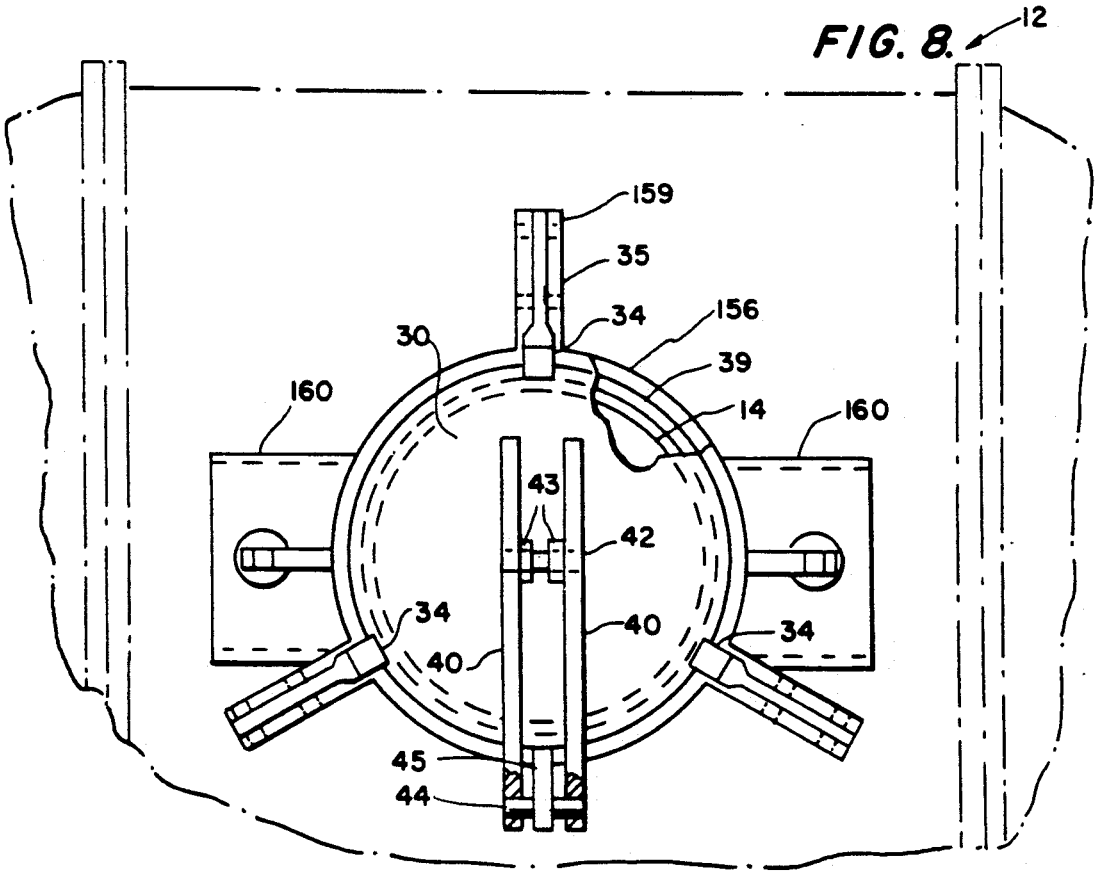

TRANSPORT UNIT FOR FLUID OR SOLID MATERIALS OR DEVICES, AND METHOD

This invention concerns the means and method for transporting fluid or solid materials such as firefighting materials or explosives, or devices such as breaching lines, and particularly concerns the transport of fluids such as chemical spill neutralizers, fire extinguishing materials, or explosive materials as gases, liquids, aqueous or organic solutions, suspensions, slurries or the like, or the transport of breaching lines for safety or construction equipment or the like to sites which are either extremely hazardous, e.g., chemical fires, or to sites which are substantially inaccessible by conventional equipment such as ladders, rope, cable or hoses which typically must be hand carried to the site.

Exemplary of such difficult sites are buildings or other areas where a fire or toxic chemical spill is in dangerous proportions, and thus substantially inaccessible. Such circumstances and the special equipment used therefor are shown in U.S. Pat. Nos. 4,625,808; 4,219,084; 4,147,216; 2,857,005; and 4,124,077. In these prior art devices, a penetrating nozzle is typically employed by forcing it against and through a wall or, e.g., the skin of burning aircraft, and fire extinguishing material then fed therethrough from a canister or through a hose affixed to the nozzle. In order to penetrate the wall or aircraft skin the nozzle is physically carried to the site and forced therethrough by an operator, either manually or by a boom mounted on a truck. It is readily apparent that such penetrating nozzle devices are undesirable from the standpoint of requiring hands on operation at the site. In another U.S. Pat. No. 4,696,347 the extinguishing chemical is encapsulated in plastic missiles which are propelled to the site by compressed gas. Such missiles are of extremely limited utility, particularly from the standpoint of not being able to penetrate a wall, window or the like, and also as being of limited fluid carrying capacity. Other problems are also inherent in the application of these prior concepts.

Particularly inaccessible sites are those where explosive materials or devices such as land mines or other unexploded military hardware are present. For these situations somewhat extreme and often uncertain measures have previously been taken to explode such hardware, including firing explosive shells into a mined area usually in a less than coordinated manner or the use of rockets or catapult launched lines of explosives across the area. These have proven to be ineffective, inaccurate and unsafe.

Objects of the present invention therefore are to provide a means and method for transporting large quantities, practically unlimited amounts, of fire fighting or other chemicals or mechanical devices to remote emergency sites which are essentially inaccessible to humans due to the structure or location of the site or the fire, or chemical or other hazards involved therewith, and to provide such means and methods which are safe and convenient to use.

Another object is to provide an accurate and safe means and method for transporting explosive materials to a hazardous location such as a mine field wherein the transportation can be of explosive material per se in the form of a cord-like explosive device, or of a hose device through which liquid or slurry of explosive materials may be fed after the hose has been propelled to the desired location.

A further object is to provide a means and method for the remote or stand-off delivery of gases, chemicals, explosives, anchoring devices, retrievable devices and equipment, safety devices, terrain breaching devices, emergency supplies, or the like, wherein the delivery power is derived from compressed, nonexplosive, nonhazardous gas.

A further object is to provide the aforesaid means as a semi of fully, self contained man portable unit of lightweight construction and manually operable from a shoulder-held or ground anchored position.

These and other objects hereinafter appearing have been attained in accordance with the present invention as recited in broad and specific embodiments below, through the discovery which is defined in its broad sense as a transport unit or launcher for gases, fluids, solids, or mechanical devices or equipment, comprising projectile launching means, projecting means adapted for positioning in said launching means, line means adapted for connection at a distal portion to said projectile means and adapted for connection at a proximal portion to said launching means, said launching means having a compressed gas chamber adapted to provide launching force to said projectile means upon actuation of said launching means.

In a more specific embodiment, the invention is defined as a fluid or solid transport unit comprising projectile launching means, projectile means adapted for positioning in said launching means, hose or line means connected at one end to said projectile means and adapted for connection at its other end to a pressurized fluid source, said launching means having a compressed gas chamber adapted to provide launching force to said projectile means upon actuation of said launching means.

In certain more specific and preferred embodiments:

a) said launching means comprises tank means providing said compressed gas chamber, and projectile barrel means mounted on said tank means thereon in fluid communication with the interior thereof;

b) a trailing portion of said line means proximate its said other end is removably connected to tether means contained within said tank means, and braking means is provided within said tank means for engaging said trailing portion for decelerating said hose means proximate the limit of its extension;

c) said braking means comprises stationary guide means mounted in said tank means adjacent to and substantially in alignment with the bore of said barrel means, the said other end of said hose means being substantially fixed in position within said tank means, movable guide means mounted in said tank means in a position non-aligned with said bore, motion resistance means mounted in said tank means engaging said movable guide means and adapted to progressively increase the resistance to motion thereof in proportion to the extent of motion thereof toward alignment with said bore, said hose means forcibly engaging said stationary and said movable guide means during said deceleration and tending to move said guide means toward alignment with said bore;

d) said line means comprises explosive cord means connected to said launching means through a nonexplosive tether means of sufficient length to allow the proximal portion of said cord means to clear said barrel means a safe distance upon actuation of said launching means; and e) said braking means comprises a fluid actuated cylinder and piston, the proximal portion of said line means being connected to one of said piston or cylinder, the other of said piston or cylinder being affixed to said launching means, and valve means in said cylinder to allow gas flow thereinto and therefrom at a regulated rate to provide a desired decelerating force to said line means.

The invention will be further understood from the following drawings and description thereof wherein certain dimensions of parts are exaggerated for purposes of clarity:

FIG. 7 is a side view of the end cap and firing mechanism mounted on the barrel end;

FIG. 8 is an end view of the barrel with the cap and lock means in place, and also showing the general outline of the pressure tank;

Figure 1:
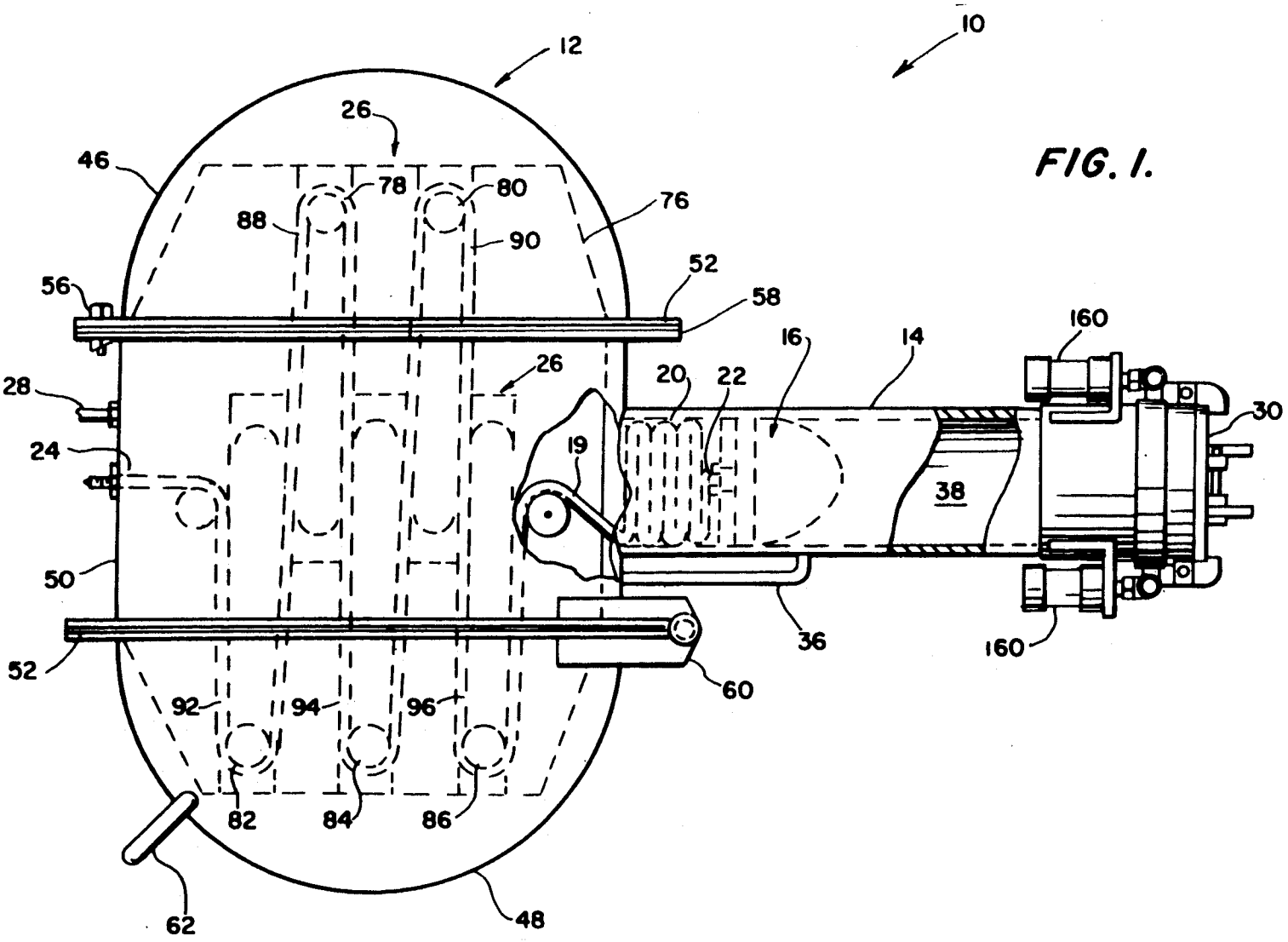
FIG. 1 is a longitudinal top, elevation view of the present device.
Figure 2:
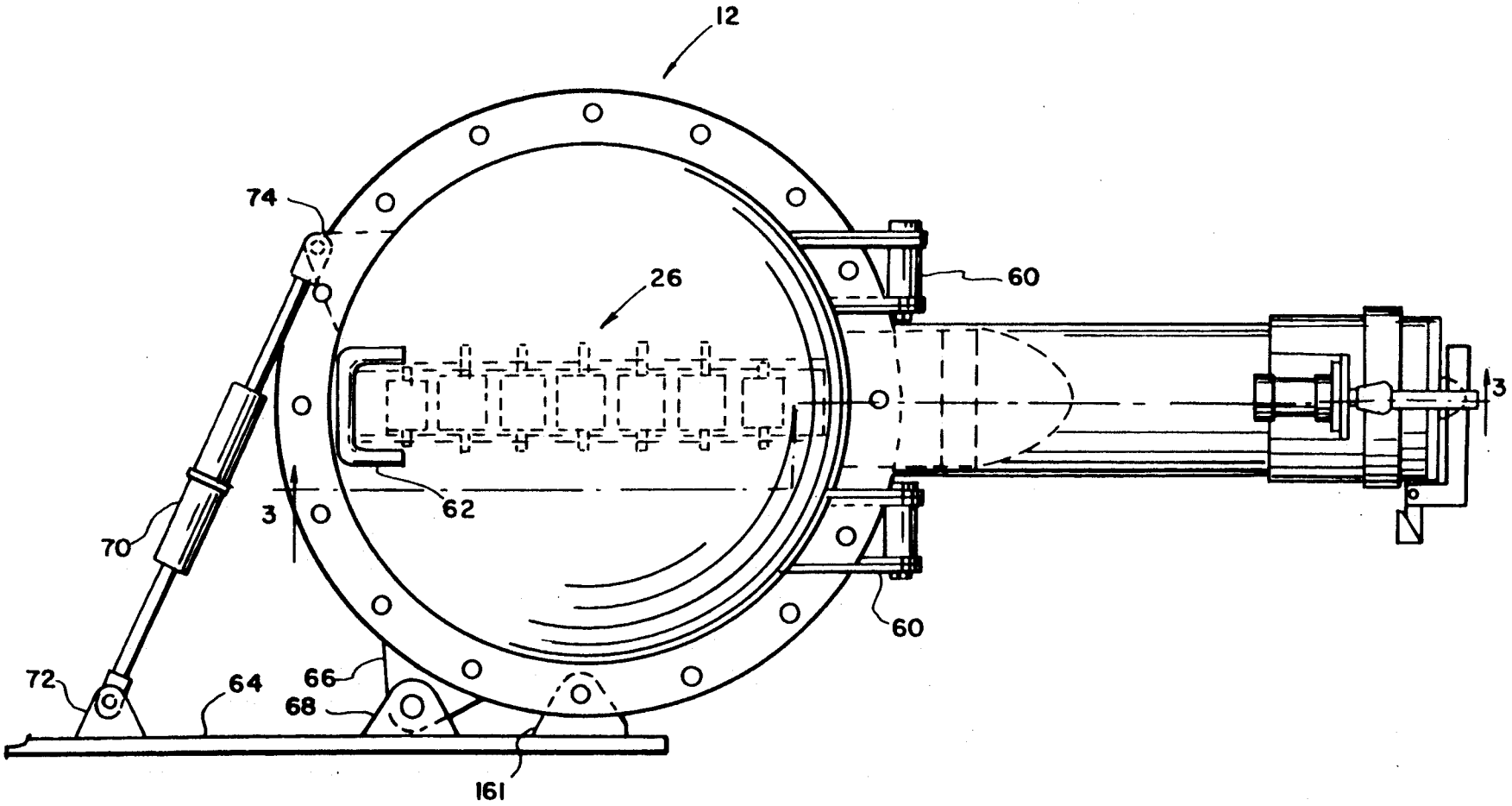
FIG. 2 is a side, elevational view of the present device.
Figure 3:
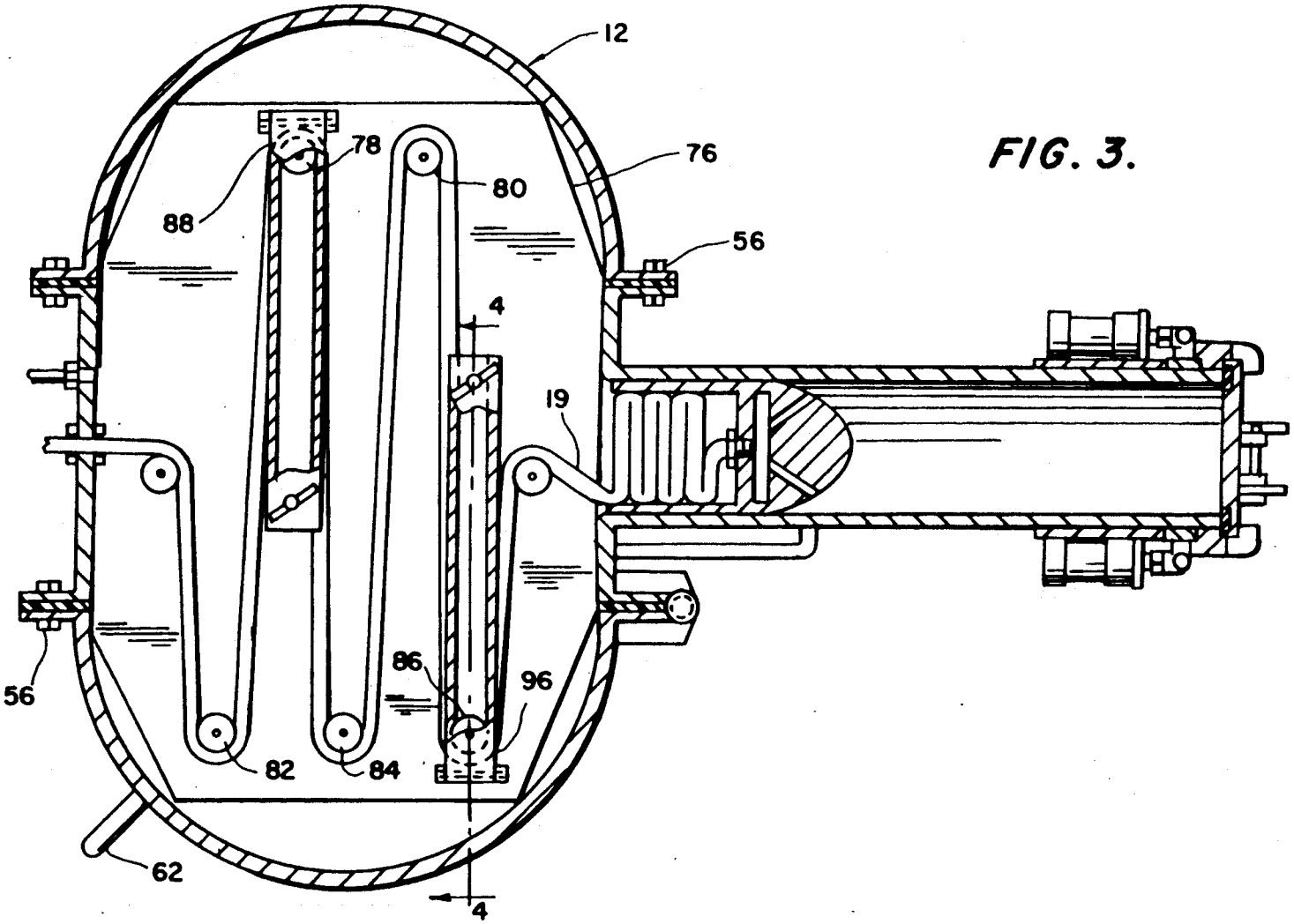
FIG. 3 is a longitudinal cross-sectional view taken along the line 3—3 of FIG. 2 in the direction of the arrows.

Referring to FIGS. 1–11 of the drawings, the transport device or launcher generally designated 10 consists of a projectile launching means comprised of a pressure vessel or tank 12 of any desired shape such as generally elliptical as shown, and a barrel 14 welded or otherwise affixed to the tank wall such as by a threaded connection or by a sealable, quick disconnect type coupling, and opening into the tank. A projectile 16 is constructed to slidably fit within the barrel and is preferably, but not necessarily, provided with sealing rings such as felt or leather rings 18 or the like which seal against the barrel bore and substantially prevent pressurized gas from by-passing the projectile during launching. A distal portion o hose or other line 19 of suitable composition and flexibility is designed to be affixed to the projectile, and the line packed in any convenient manner in the hollow trailing end 20 of the projectile such that the hose will readily uncoil or unravel and extend as the projectile is propelled from the barrel and while in flight to the fire or other emergency site.

A braking means is provided to forcibly engage the line or at a proximal portion thereof as the line nears the end of its full extension to decelerate the projectile at a rate such that its momentum will not snap the line or jerk it from its connections 22 or 24 to the projectile or to the emergency fluid source, respectively. The type of frictional braking means shown in FIGS. 1–6 generally as 26 around which the line is looped is preferred in that it provides deceleration and then dead-stop of the line, without any retraction thereof.

The pressure tank 12 and barrel 14 are designed to hold pressures of up to several thousand psi, e.g., 5,000 psi or more, however, for many, non-military uses, the launcher typically need only be pressurized to about 20–40 psi to propel the projectile and the necessary footage of line to the target site. In this regard it is usually necessary to employ no more than about 400 feet of, e.g., 0.5–0.75 in. I.D. hose to reach most emergency sites in safety though this patent includes firing of such projectile means much further than that. The pressurization of the tank through inlet 28 is conveniently done with air, although nitrogen, carbon dioxide, helium or the like may be used.

The end of the barrel is provided with a cap 30, preferably provided with an annular elastomeric sealing ring 32 or an equivalent seal, which cap is held securely in its sealing position preferably by fingers 34 pivotally mounted on pins 35 press fitted into brackets 37, which brackets are welded to sleeve 39 affixed to the end of the barrel, e.g., by press-fit. In actuating or firing the launcher, fingers 34 are rapidly and forcibly pivoted out of the way of the cap as described in greater detail below to exit the projectile. In a preferred embodiment, suitable conduit means such as 36 forms a fluid connecting between the tank and pre-exit cell 38 of the barrel such that the pressures on each end of the projectile are equalized prior to firing. This allows the projectile to be positioned well away from the cap, thereby reducing the possibility of the projectile striking the cap on firing. Also, the pressure in cell 38 will rapidly fling the unlocked cap downwardly and away from the projectile trajectory by way of arms 40 pivotally connected to the cap by pin 42 and brackets 43 welded to the cap, and to the barrel by pin 44 and bracket 45 welded to the barrel.

The present launching device and its operation have been described above in general terms, and a more detailed description of its components follows. The tank 12 is preferably comprised of steel press formed end domes 46 and 48, and rolled, welded steel middle section 50. Bolt flanges 52 are welded to the domes and flanges 54 are welded to the middle section. These flanges are adapted to be secured together by bolts 56, preferably with a thin, pressure sealing gasket 58 therebetween to form a gas tight pressure vessel. Either or both domes may be hinged by any convenient type of hinge such as shown at 60 to facilitate resetting or maintenance of the braking device or other components, especially where the launcher is of large and heavy construction. For this purpose a handle such as 62 may be provided on either or both of the domes to make it easier to rotate them to their closed positions wherein the bolt holes in the flanges are aligned.

The launcher 10 is preferably mounted on a substantially horizontally rotatable platform 64 on the flat bed of a truck or the like and typically, for relatively contained chemical spills or fires, will be about four feet long and about three feet in diameter across the middle section, and, along with the barrel, hose and braking means will weigh about 500 pounds. Obviously, larger or smaller units can be employed for special situations. The tank is preferably also provided with pivotal mounts comprising brackets 66 on the launcher pivotally connected to brackets 68 on the platform 64. A ratchet turnbuckle 70 is pivotally connected at one end to a bracket 72 on the platform and at its other end to a bracket 74 on the tank such that the elevation of the barrel can be adjusted with respect to the target. A stop such as 75 may be provided to limit the downward rotation of the launcher. It is noted that it is not Applicants' intention here to specify or limit in any way the type or complexity of the aiming and firing control mechanism for the launcher, and the rotatable platform 64 and turnbuckle 70 are only representative of a rudimentary control mechanism which may be employed. For example, any of the highly sophisticated computer controlled, electronically actuable hydraulic devices employed for aiming and firing military weapons may be used to aim the launcher at the emergency site, including laser guided aiming devices.

Figure 4:
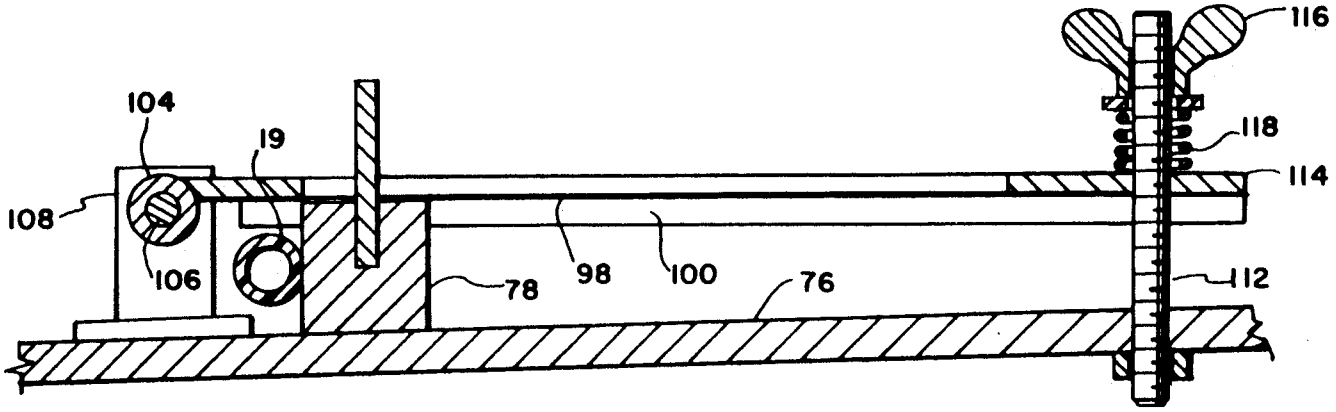
FIG. 4 is a longitudinal cross-sectional view of a braking segment taken along line 4—4 of FIG. 3 in the direction of the arrows.
Figure 5:
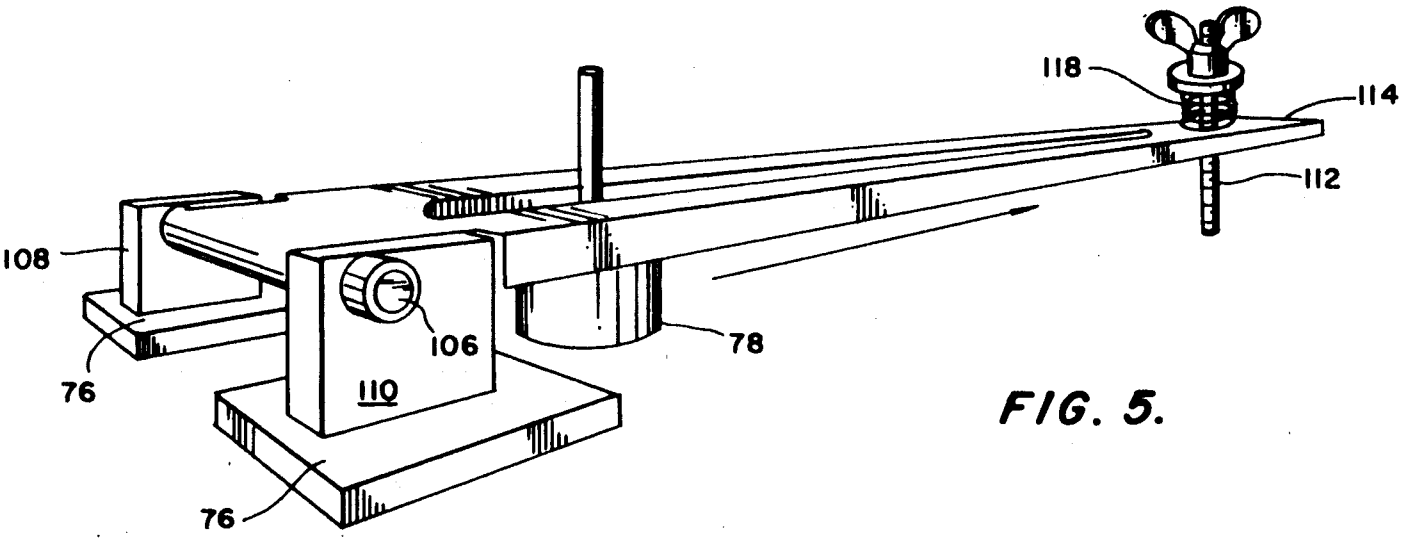
FIG. 5 is an isometric view of a braking segment.
Figure 6:
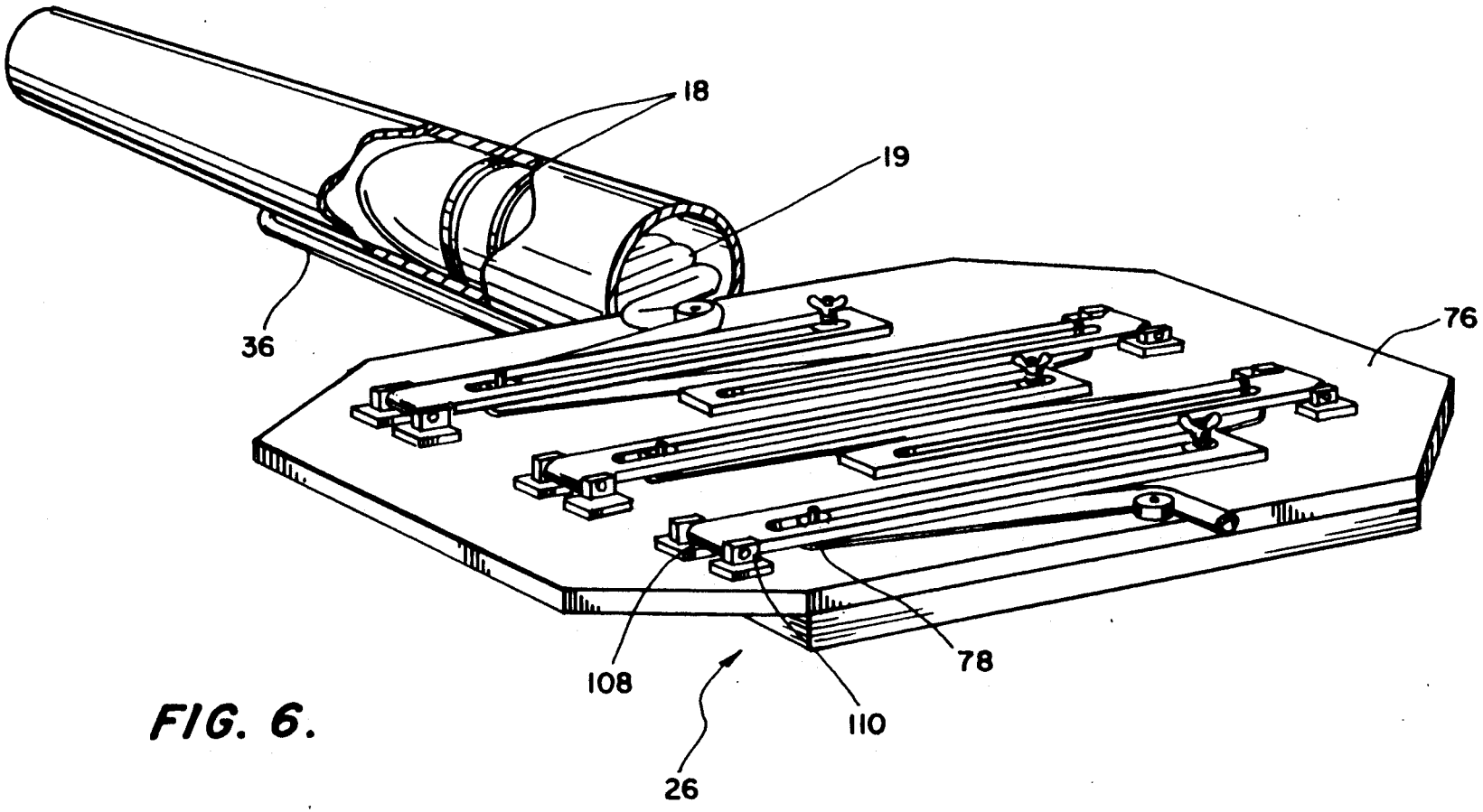
FIG. 6 is an isometric view of a complete braking means assembly showing its spatial relationship to the launcher barrel.

The braking means generally designated 26 in FIGS. 1–6 comprises base plate 76 and a plurality of movable guides 78, 80, 82, 84, 86 mounted between the base plate and a plurality of motion resisting, friction elements 88, 90, 92, 94, 96 respectively. The guides are preferably roller shaped but may be of other shapes provided the surfaces thereof which contacts the hose are smooth and non-abrading thereto. In the embodiment shown, one end of each guide roller rests on the base plate 76 and the other end lies adjacent the inner or underside 98 of a friction element. These elements preferably have a channel shaped cross-section as shown in FIGS. 4 and 5, wherein, with respect to an exemplary element 96 the roller 86 is slidably and rotatably positioned between the flanges 100 and 102. These elements are pivotally mounted at one end 104 by pin 106 secured in supports 108 and 110 welded or otherwise affixed to base plate 76. A threaded stud 112 affixed to base plate 76 extends through the other end 114 of the element 96 and is provided with a wing-nut 116 and compression spring 118 for adjusting the distance between the element and base and thus the frictional resistance to motion of roller 86 toward end 114 of the element. In this regard, with such a brake, the heavier the spring 118 and the closer the element end 114 is brought initially to the base plate 76, the more frictional resistance to motion of roller 86 there will be and the more rapid will be the deceleration of the line. It is noted that while the roller may initially rotate as deceleration begins, it is quite likely that the frictional forces against its ends will stop its rotation and allow only linear translation thereof toward end 114 such that sliding of the line across the roller surface will occur. The actual braking forces on the trailing or proximal portions of the line are complex and in addition to the frictional resistance imparted by the elements described above, will include certain mechanical advantages and vectors developed by translation of the rollers toward alignment.

Figure 9:
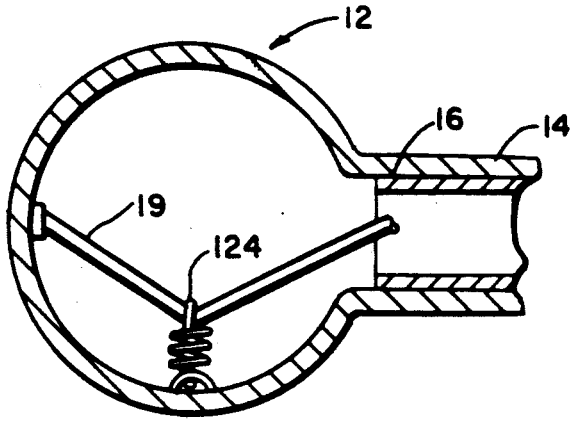
FIG. 9 is a view of a tension spring variation of the braking means.

Referring to FIG. 9, the braking means may comprise one or more tension springs such as 120 mounted in the tank, attached at one end 122 to the tank and attached to or engaging the line at its other end 124. The deceleration of the hose simply results from resistance of the spring to extension as the line attempts to straighten out. The strength and size of the spring, the dimensions of the loop 126 of the line, and the points of attachment of the spring can be adjusted to give the desired deceleration.

Figure 10:
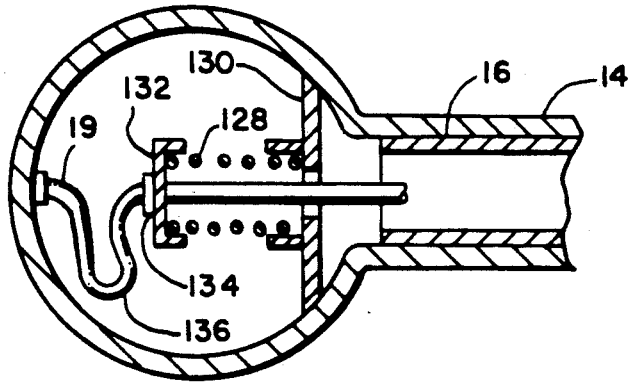
FIG. 10 is a view of a compression spring variation of the braking means.

Referring to FIG. 10, the braking means may comprise a compression spring 128 compressible between bracket 130 affixed to the interior of the tank, and retainer 132 affixed by mechanical or adhesive attaching means to the line as at 134. The line is looped at 136 in an equivalent manner and purpose as loop 126. Again, the strength and size of the spring and the size and location of the loop may be adjusted to provide the proper deceleration.

Figure 11:
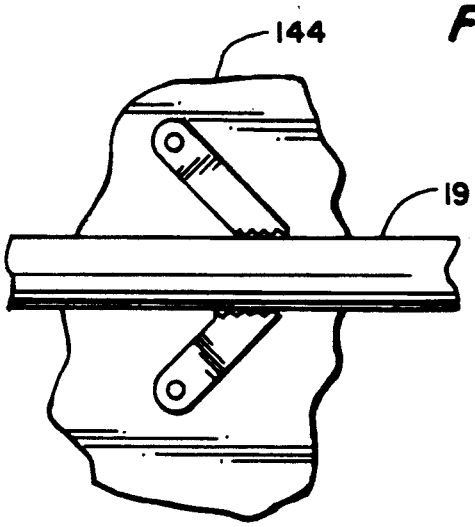
FIG. 11 is a side elevational view of a hose back-up preventing lock.
Figure 12:
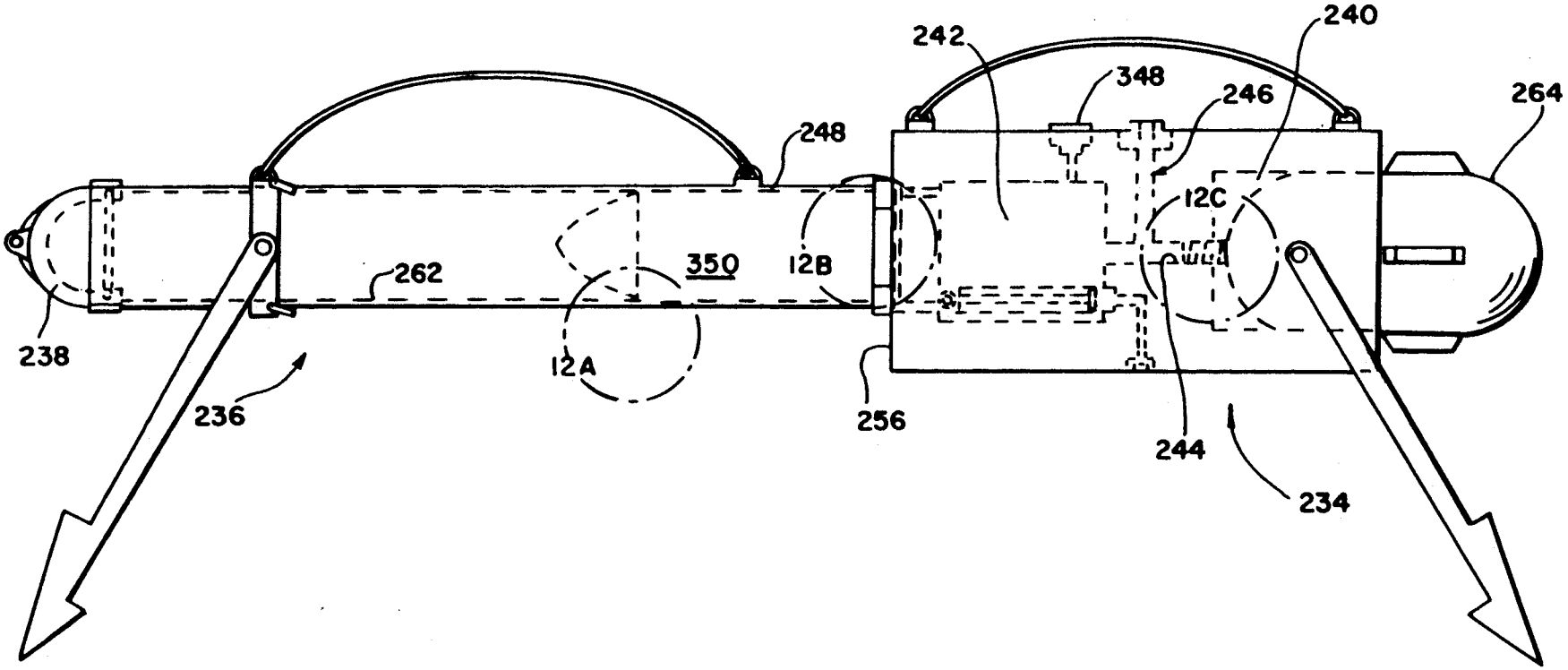
FIG. 12 is a side elevation of a manually transportable and operable embodiment of the present transport unit.
Figure 12A:
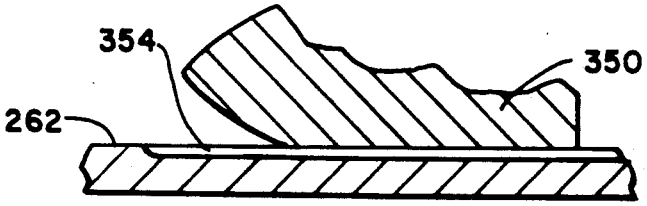
FIG. 12A is an enlarged fragmentary sectional view of the area bounded by circle 12A shown in FIG. 12.
Figure 12B:
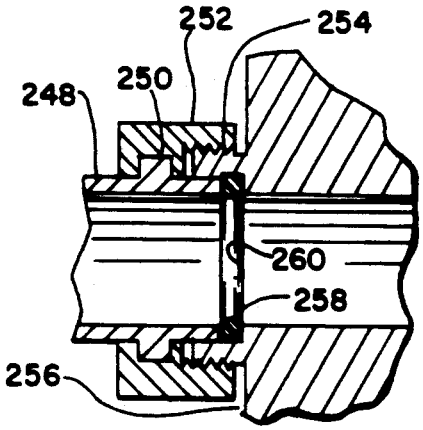
FIG. 12B is an enlarged fragmentary sectional view of the area bounded by circle 12B shown in FIG. 12.
Figure 12C:
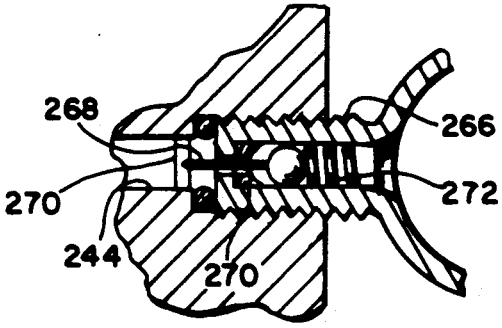
FIG. 12C is an enlarged fragmentary sectional view of the area bounded by circle 12C shown in FIG. 12.
Figure 13:
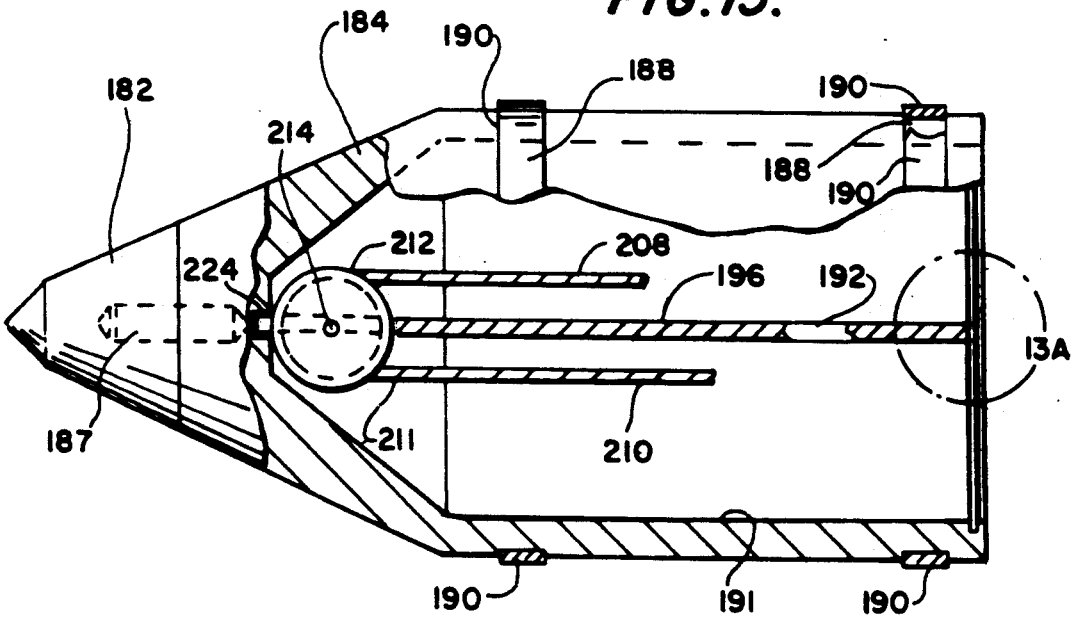
FIG. 13 is a longitudinal, partially cross-sectional view of trolley line anchor embodiment of the present projectile adapted for securing a line pulley mechanism to the projectile landing site.
Figure 13A:
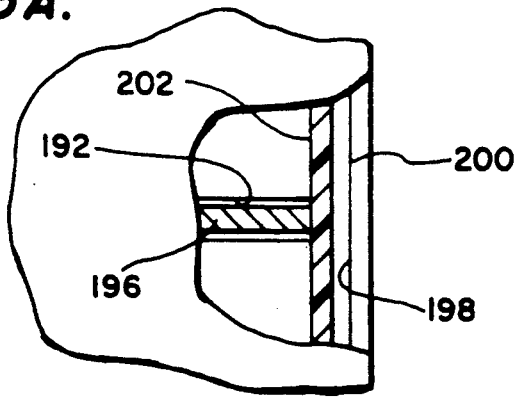
FIG. 13A is an enlarged fragmentary sectional view of the area bounded by the circle 13A shown in FIG. 13.
Figure 14:
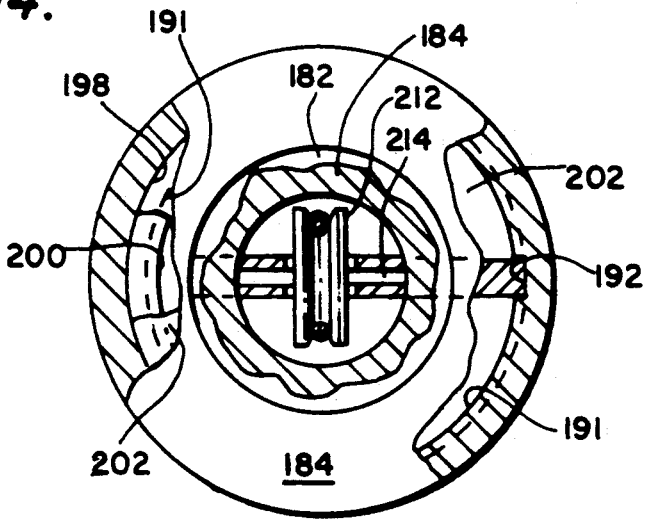
FIG. 14 is a front view of the projectile of FIG. 13 with portions shown in cross-section for detail.
Figure 15:
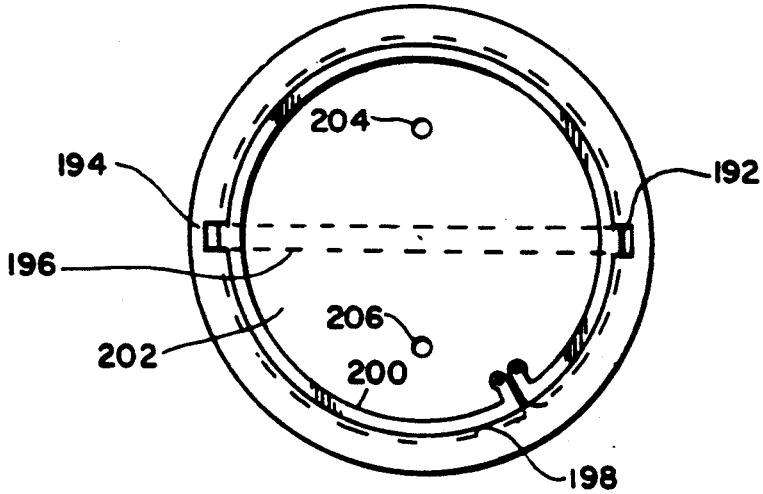
FIG. 15 is a rear elevational view of the projectile of FIG. 13.
Figure 16:
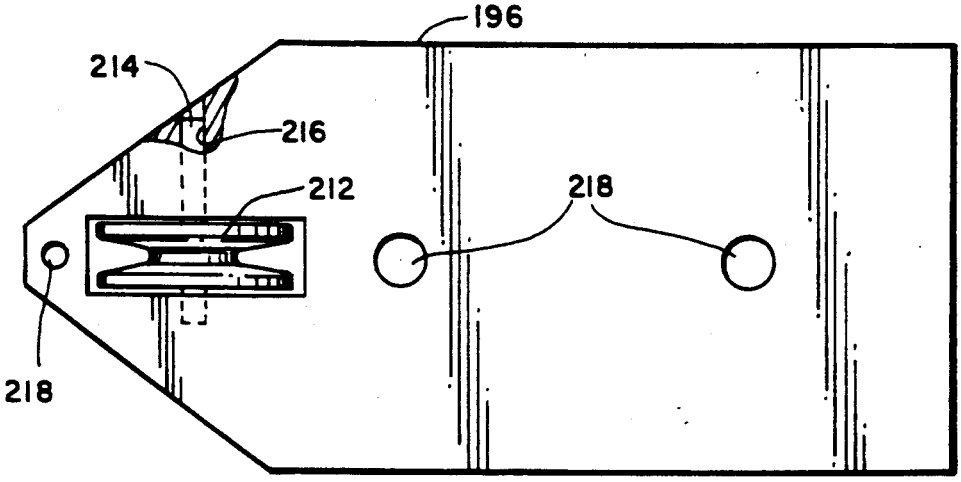
FIG. 16 is a plan view of the retainer plate and pulley assembly.

It is noted that the braking means of FIGS. 9 and 10 will tend to retract the projectile to a small extent, however, various hose return prevention means are known to the art and can be employed to prevent such retraction. One such device is shown in FIG. 11 and comprises arms 138 and 140 mounted for pivoting on pins 142 secured to a bracket 144 mounted within the tank. These arms readily pivot outwardly and allow the line 19 to be yanked toward the target, but when spring or other force tends to retract the line back toward the tank, the arms pivot inwardly and clamp onto the line to stop its retraction.

The projectile 16 may be widely varied in shape but preferably is constructed or formed as a steel shell generally designated 145 having a penetrating head portion 146 and rearward cylindrical portion 148. A hose or line connector plate 150 is welded into the shell and communicates through aperture 151 with a plenum 152 provided with a plurality of fluid outlet ports 153 paced peripherally around the shell and of proper size and number to provide adequate emergency fluid flow, spray, jet, foam, or other pattern to the site. The line 19 is connected, at one end 22, e.g., by a conventional pressure line, tapered threaded connector 154 into aperture 151, and at its other end 24 by equivalent means to a source of emergency fluid such as employed for fire fighting or for treating chemical spills. Any appropriate valving means may be employed for pressurizing the hose and emitting the emergency fluid through ports 153, preferably just as the projectile reaches its target. The head portion 146 may be hollow or weighted, depending on the type of obstruction the projectile must penetrate, if any. Also, the projectile may be provided with fins or the like in known manner to impart rotation thereto or otherwise for stabilizing its trajectory.

Referring to the drawings, particularly to FIGS. 7 and 8, the barrel cap 30 is locked by or released from fingers 34 by means of ring 156 longitudinally slidable on sleeve 39 and pivotally connected to the fingers by links 158 and pins 159. Ring 156 operates to release the fingers as it is pulled (to the left in FIG. 7) by means such as double acting air or hydraulic cylinders 160 or equivalent solenoid devices mounted preferably on opposite sides of the sleeve 39 or barrel. Likewise, fluid pressure on the opposite side of the piston of cylinder 160 forces the ring 156 to the right in FIG. 7 and levers the fingers clockwise about their pivot pins 35 to force and lock the cap against the barrel end to seal the same.

The signal or operation which actuates cylinders 160, or an equivalent power mechanism, to release the cap and fire the projectile can derive from remote control, manual activation, computer controlled means, or the like. It is noted that when the fingers 34 are released, the cap will fling outwardly and downwardly around pivot pin 44 with substantial force and could possibly rebound off the barrel or a stop such as 161 shown in FIG. 2, back into the projectile. In order to positively prevent such from occurring a segment 162 shown in FIG. 7 is provided on the arm 40, and a catch generally designated 164 is provided on the barrel or sleeve 39. This catch comprises a latch member 166 pivotally mounted by pin 168, e.g., in a channel 170 welded to the barrel or sleeve, and urged outwardly as shown by a spring 172 affixed in the channel. As shown by the dotted line segment portion in FIG. 7, the end 174 of segment 162 will be thrown in an arc against member 166 and force it to pivot inwardly against the spring 172 as the cap is flung downwardly. End 174 will then become latched behind the shoulder 176 of the latch member as spring 172 instantly forces the member pivotally outwardly after end 174 passes beyond it.

The above defined launcher in more specific terms and a preferred embodiment comprises a compressed air mortar capable of propelling at 20 psi launch pressure a 201*b*. steel projectile with line attached through two "re-bar" reinforced block walls form a distance of 100 ft. with extreme accuracy and a range of between about 1,000 and 3,000 ft. This device, in certain preferred embodiments, is comprised of the following components and materials:

(1) A hydraulic tube steel barrel 4 to 5 ft. in length and 8 to 10 inches I.D., using standard hydraulic tubing for high performance with reliability over long periods of time;

(2) An air accumulator or compressed air tank of approximately 32 inches by 28 inches internal end cap area, or larger. The overall wall length of the accumulator from end cap to end cap is at least about 40 inches of high strength rolled steel, the wall and end caps being approved for high pressure vessels. The end cap seals are seated in grooves and are standard off-the-shelf items comprised of "0" ring material of neoprene rubber with an I.D. of ¼ inch;

(3) The internal inertial breaking system is comprised of cold rolled steel guides and rollers, thus assuring malleability and ease of machine tooling. The rollers positioned on opposite sides provide opposite inertial loading. The entire breaking system mounts on a single mounting bracket allowing for easy installation and maintenance;

(4) The air compressor may be either gas or electrically operated producing 17.5 CFM and having a 30 gal. compression tank rated at 250 PSI. An alternative source of force to propel the projectile with enhanced speed of firing and/or more silent operation is non-toxic, non-polluting, pre-compressed dry nitrogen available from standard industrial gas bottles;

(5) The pneumatic operated triggering device located at the muzzle, for ease of operation can be activated by the press of a button, thereby releasing the compressed air in the barrel, causing an arterial (vacuum) effect launching the projectile through the barrel in such a fashion that it causes an initial acceleration of the projectile in excess of about 125 mph/sec. Additional force created by the pressure from the accumulation chamber behind the projectile in the barrel provides containing momentum to accurately propel the projectile and line in a relatively flat trajectory to the point desired. This triggering device employs a clapper type valve with a valve seal of multi-layered neoprene rubber with high strength inner core of reinforced fiberglass. This type of seal was chosen for its ability to maintain memory, extreme high pressure, and its unique capability to survive extreme changes in temperatures; and (6) A control panel houses all pneumatic and electrical controls and is a steel plated, water-tight cabinet with one way vent protection which allows moisture and air to escape while still protecting the control panel from outside contaminants. All electrical connections are industrially hardened to assure reliability and durability. Air gauges are oil-filled, allowing for accuracy and durability and are resistant to shock and vibration. The control panel has multiple inputs and outputs for pressurizing the accumulation chamber and/or barrel and/or for fluid pumping. The electrical source for the control panel is both a 12 volt subsystem generator and an auxiliary battery. All switches are color coded plastic buttons and large plastic tags are affixed to the control panels around control switches for ease of identification. All pneumatic hoses are double reinforced hydraulic hoses which meet or surpass all require operating pressure ratings.

The projectile is a container designed to carry the line across the area it is desired to breech, clear, or traverse, and is comprised of the following structure and materials:

(1) A bullet shaped body made of steel, molded fiberglass or injected plastic or composites which forms a tight fit with the internal measurements of the barrel of and is approximately 27 to 36 inches long;

(2) A hollow nose cone capable of being filled with heavy material to add mass to the projectile if and where needed; and (3) A connector joining the line securely to the inside of the nose of the projectile.

The hose is comprised of 6 to 14 mil. mylar plastic, extruded or sealed in continuous rolls of whatever length may be necessary not to exceed about 1,050 to about 3,050 ft. and is pre-packed in the projectile for whatever distance of firing is desired as set forth above.

The explosives which may be used are line charges comprised of hoses or tubes filled with a liquid binary slurry such as IRECO's DBA 105p slurry which is configured so that the two non-explosive components are stored separately, and not mixed into an explosive mixture until they are being pumped into the hose. Since these explosives require a minimum 2 inches diameter mass to critical explosive sensitivity, they can be pumped through the launcher or externably thereof by means, e.g., of a 1 inch line delivery hose from a point safely away from the explosive line change to a point where the critical mass 2 inch hose or tube begins. Pumping of explosives of each 1,000 feet can be accomplished every 2 minutes. When a 2 inch (I.D.) hose or tube is filled with the slurry explosive, its weight is approximately 2.5 lbs/ft.

An alternative explosive line charge that may be used is the plastic "Detasheet" variety produced in 1 inch diameters by DuPont and also pre-packed in the projectile for distances of up to 1,000 ft, or a foam explosive dis through sprayer-soaker type hoses.

The explosive line charge is able to detonate and/or deactivate normal anti-personnel mines of the pmn and pmf varieties out to about 44 ft. from the point of the line charge, for the entire length thereof.

A typical system for delivering the explosives includes a "pumper-mixer" unit connected to a storage facility for both the liquid and the solid components of the binary slurry and connected to the filing hose either through the launcher directly, or separately from the launcher as desired, and may be either internally contained with the launcher or supplied by a trailer or auxiliary vehicle. The Dupont C5 plastic "Detasheet" produced in inch diameters may be housed in the projectile as it is quite insensitive unless intentionally detonated or actually hit by, e.g., a 20 mm. shell or burned with an acetylene torch.

Typical hoses to be used for fire fighting, e.g., are 1" to 1½ to 2" diameter, single jacket, 500PSI test, lightweight forestry type hose constructed of abrasion resistant high strength synthetic yarn with a designed liner that allows controlled seepage of fluid, under pressure, to the surface of the jacket. This self protecting feature shields the hose from the effects of heat.

Another such fire hose is comprised of cotton/-polyester, single jacket, 450 PSI test. This hose is a rugged forestry type 1" to 1½" diameter with a synthetic, ozone resistant, non-acid forming, extruded rubber lining, of lightweight construction for use with pumpers and tanks, furnished with clear mildew treatment and will not tear under rough usage. This hose is typically used to tether within the braking system.

Typical specifications for a Mylar hose useful for transporting explosives is as follows:

Dimensions: 1" ID, 2" ID and 3" ID;
Tube: Single ply DuPont mylar type "A";
Wall thickness: 6.0075 to 0.012 inches;
Reinforcement: None;
Cover: None;
Pressure: Maximum working: 150 PSI;
Temperature range: −70 to +150 degrees fahrenheit;
Length: Up to 3000 feet;
This hose is useful in a system deployment utilizing Ireco DBA 105P slurry explosive, and of Mrel Lexfoam explosive.

The fire extinguishants which are used vary according to the class of fire. For classes A, B, and C fires NAF type is preferred. For the same classes and for D type fires and for hazardous spills, a number of compounds from I-TECH are employed. The NAF is a new extinguishant in the vaporizing liquid class and is described as a Composite Advanced Halon. NAF has a varible specification due to the fact it can be altered to suit particular operational conditions worldwide. The material used in a tropical climate could differ from in a temperate zone and when used in a small hand operated extinguisher it would differ from that used in total flooding systems or for pumping such as with the present device. The specifications for European manufacture are given below:

| | |
|---|---|
| Appearance | Water white liquid |
| Specific Gravity | 1.48 + 0.01 |
| Boiling Point | 14 Centigrade |
| Pressure at Bar & 20 Deg. Centigrade | 15.5 psig |
| Solubility | Water, max 0.1 weight % at 26 Deg. Centigrade & 1 Bar. Soluble in alcohols, Hydrocarbons, and chlorinated solvents. |

Typical design and operating specifications for the present transport unit for fire-fighting are as follows:

| | |
|---|---|
| Range | 125 feet |
| Nozzle Diameter: | 8" |
| Hose I.D. | ⅜" |
| Propulsive Force: | Compressed Air |
| Launch Pressure: | 60 PSI |
| Brake: | Inertial Friction |
| Extinguishant Volume: | 2.0 cubic feet |
| Extinguishant Pressure: | To 300 PSI |

A manual mortar or manually transportable and deployable transport unit embodiment is described below and comprises a tactical hand-held, compressed air operated line launcher which launches a projectile that may or may not carry any form of line including a Detcord, Deta Sheet or other form of explosive line charge grappling hooks, pulley systems, hoses for dispersing fire suppressants and other chemical agents, and other items over substantial distances with great accuracy. It has, preferably, an overall length of less than about five and one-half feet, a barrel diameter of approximately eight inches of fiberglass or molded plastic composites or reinforced light metals, a total width of less than about twenty-four inches, and weighs less than about thirty pounds, not including the weight of the explosive line charge. The launcher operates on stored compressed air or air compressed by a hand or foot operated pump at relatively low pressures and medium volumes depending upon the range and force desired.

By comparison, the device of FIGS. 1–11 generally is used as a vehicle mounted, compressed-air-operated, 200 mm. launcher capable of launching heavy lines and materials such as explosive line charges, grappling hooks, pulley systems, hoses for dispersing fire suppressants and other chemical agents, and other items over substantial distances with great accuracy.

The manual mortar is provided with an openable breech that is screwed or otherwise attached to the end of the barrel so as to create an air tight seal when closed. When opened, a projectile that will form a close fit with the inside of the barrel can be inserted into the rear portion thereof to a point not more than about four feet from the front or muzzle end of the barrel. The projectile typically includes a line to be fastened to a tether line inside of the breach and connected to with an inertial braking system to stop the projectile in mid flight at exactly the point where it is desired to be stopped and which may be attached either to a line, pulley system or similar device inside the projectile, or to a hose or line charge which may be folded or rolled inside the diameter projectile.

The projectile may weigh anywhere from 5 to 50 lbs. depending upon its construction and/or purpose, and feeds the line it is carrying out of its trailing end as it is propelled through the air. Generally, the propelling pressures will vary from about 25 to about 5,000 psi. When the projectile reaches the end of the line which is of preadjusted length, it will be stopped by the inertial braking system in the launcher and stop at a predetermined point in mid-air. At that point it will either set off the line charge that it is pulling, at whatever altitude may be desired, or it will fall to the ground or through or against a wall as desired, with whatever type of line it has been carrying. It may also be used to launch smart projectiles. If a grappling type hook type projectile is used it will hook into the ground or wall and allow a heavy line charge or other device or larger line to be pulled across the area or void traversed by the projectile.

The muzzle or front end of the barrel is provided with a firing or trigger cap which is activated by pulling a firing pin or the like and which, until fired maintains the desired air pressure in an accumulator in the breach and in the barrel both in front of and behind the projectile. When the firing pin is pulled the cap is blown by the compressed air in front of the projectile off the barrel ahead of the projectile and releases the stored energy of the compressed air thus carrying the projectile with the necessary force to complete its mission. Projectiles with 8" diameters, weighing up to 42 lbs. and carrying 200+ feet of hose have been fired from a four foot barrel on the vehicle mounted version at 40 psi for ranges of 200+ feet with great accuracy. This mortar may be carried loaded and charged, or may be loaded and charged immediately before firing.

Referring to FIGS. 12 and 20–22, this manually transportable and operable embodiment of the launcher is shown and comprises, in a typical, exemplary embodiment, a breech generally designated 234, a barrel generally designated 236, and a firing or end cap 238. The breech comprises a gas pack cavity 240 and a gas accumulator cavity 242. This breech is preferably of steel and capable of withstanding 4500 internal psi or greater. The two cavities are adapted to be interconnected by conduit means such as passage 244 in which a gas pressure regulator and shut-off valve generally designated 246 is positioned. The barrel 236 is provided on its proximal end 248 with an annular shoulder 250 on which is rotatably mounted a threaded nut 252. An annular threaded projection 254 on the breech front 256 matingly receives nut 252. These threads may be of any pitch, preferably of a quick disconnect type such as Haliburton threads. An O-ring or equivalent type annular seal 258 is interposed between the proximal end of the barrel and an annular shoulder 260 on the breech front to provide a gas-tight connecting seal between the barrel bore 262 and the accumulator cavity 242 capable of sealing pressures of 4500 psi or higher.

A gas pack or cylinder 264 is provided at its discharge end 266 with suitable valving such as a spring biased ball 268 and annular seal 270. End 266 is threaded for screwing into the breech body adjacent passage 244. The breech body is provided with an actuator nib 268 positioned with in the passage 244 on bracket 270 and adapted to depress ball 268 against spring 272 to load chamber 242 upon the opening of valve 246. Pack 264 is provided with grip segments 274 for facilitating the screw connecting and disconnecting of the pack and breech.

Positioned on the launcher, preferably within accumulator chamber 242 is a dashpot type braking means generally designated 275 comprising a cylinder 276 having a bore 278, a piston 280, and a piston rod 282. The piston is preferably provided with an O-ring or equivalent type seal 284 for preventing blow-by at the cylinder wall 286, and the piston rod sealingly slides through a similar seal 288 mounted in the apertured end 290 of the cylinder. The other end of the cylinder bore is provided with an elastomeric seal 292 surrounding the port 294 of a bleed passage or conduit 296 in which is threadedly mounted a bleed control needle valve or equivalent 298. A gas pressure relief port 300 is provided through piston head 280. A gas pressurizing, one-way valve 302 is provided on the cylinder and comprises a gas inlet fitting 304 to which can be attached an inlet tube 306 which may be connected into a pressurized gas source external to the accumulation chamber. Alternatively, the valve 302 may communicate directly with the accumulation chamber for pressurizing the cylinder. This valve is provided with a one-way opening valve member such as metal spring leaf 308 affixed to the valve body by screw 310. The dotted lines show the open, resiliently flexed position of spring leaf 308, when gas is flowing into the cylinder bore through ports 312 and 314. The exposed end of the piston rod is connected to the projectile line or a tether 316 attached to the line.

In the operation of this braking means, bore 278 is pressurized a desired degree, e.g., 1000 psi., directly from the accumulator chamber and valve 298 is adjusted to provide a desired bleed gas flow from said bore through port 300 and conduit 296. It is noted that for certain braking requirements, valve 298 would be unnecessary since port 300 could provide the necessary pressure drop across the piston. With port 300 isolated by seal 292 from conduit 296, the brake is ready for use. It is noted that the flow areas and conduit 296 can also be selected to give the proper braking action.

Figure 21:
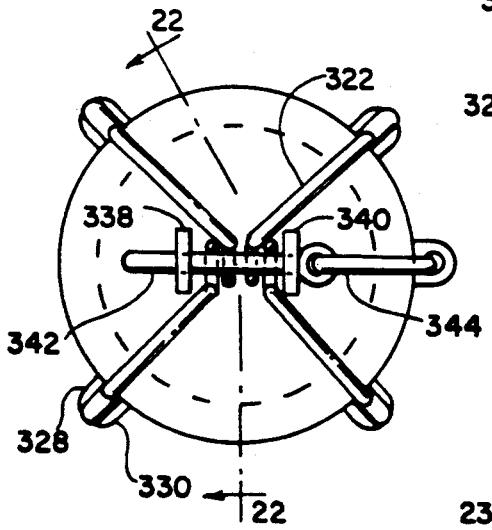
FIG. 21 is an end view of the barrel of the unit of FIG. 12 showing the firing cap and retaining elements.
Figure 22:
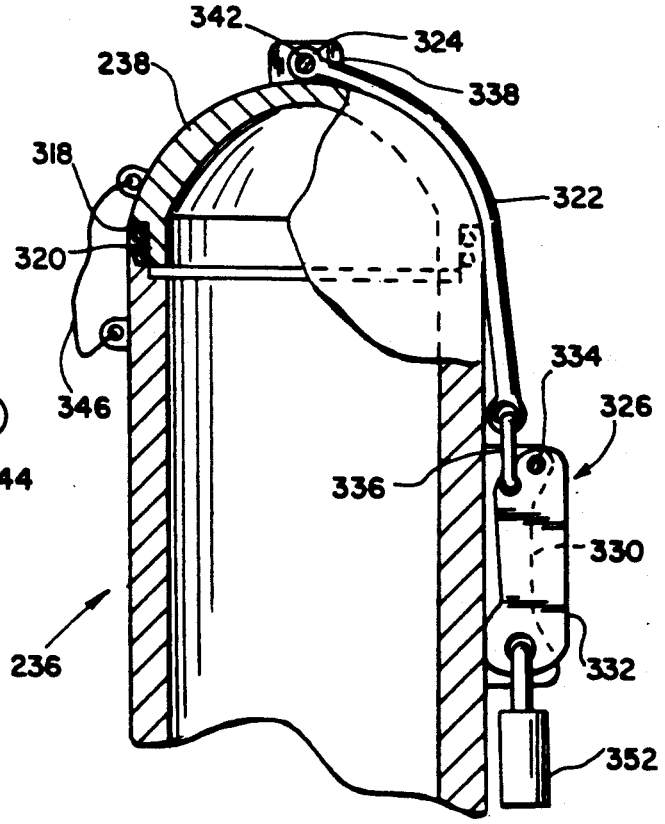
FIG. 22 is a side view of the firing end of the barrel, partially in section showing and exemplary overcentering, safety retaining mechanism for the firing cap.

Referring to FIGS. 21 and 22, the firing cap 238 is dome shaped having an annular stop shoulder 318 for abutting the end of barrel 236, and an inner sleeve section 320 for tightly sealing against O-ring or other equivalent seals provided suitable annular grooves in the barrel bore end. It is noted that the sealing is enhanced by slightly inwardly tapering toward the breech end said segment and said bore end.

Cap 238 is provided with a retaining means of any convenient construction, however, from the standpoint of simplicity, ease of use, reliability and safety, the retaining means shown in FIGS. 21 and 22 is highly preferred. This retainer comprises a plurality of strong cables or stainless steel rods or the like 322, each provided on one end with a loop 324, and linked on its other end to a tensioning device, preferably an overcentering latch generally designated 326 and comprising in an illustrative embodiment a pair of spaced supports 328, 330 welded or otherwise affixed to the barrel and between which is a tensioning handle or lever 332 pivotally mounted on the supports by pin 334. Cable 322 is pivotally affixed to handle 332, by a link 336 or other such means.

Figure 17:
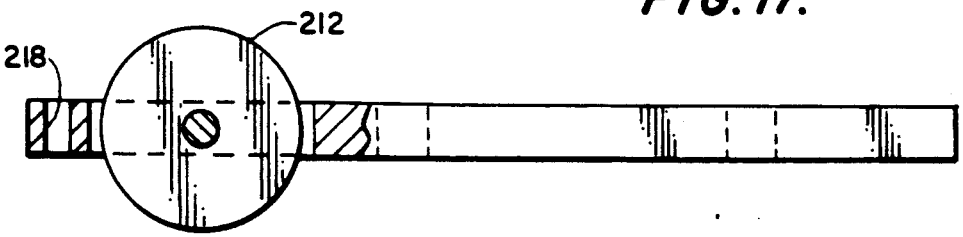
FIG. 17 is a side or edge view of the assembly of FIG. 16 with portions shown in cross-section.

A pair of spaced projections 338 and 340 welded or otherwise affixed to the cap slidably receive firing pin 342 to which is attached a lanyard of cable or the like 344. A tethering mechanism such as arm 40 shown in FIG. 17, or a strong line such as 346 may be affixed as shown to the cap and barrel for preventing loss of the cap on firing.

In readying the launcher for firing in a typical operation, air pack 264 pressured to about 4500 psi., is screwed into place in chamber 240. A projectile 350 carrying a packed line is inserted into the breech end of the disassembled barrel, packed line affixed to the breech. The firing cap 238 is set into the carrel end, the loosened free ends of the cables 322 placed between projections 338, 340 and firing pin 342 inserted through the projections and loops 324 as shown in FIG. 21. Levers 332 are then rotated downwardly to their overcentered positions as shown in FIG. 22 and suitable locking means such as pad locks 352 or equivalent safety means inserted through aligned apertures in supports 328, 330 and lever 332. It is noted that the cap retaining forces generated by levers 332 are quite high and prevents premature, unintentional withdrawal of firing pin 342. Valve 246 is then opened to bring the gas pressure in accumulator chamber 242, in braking cylinder 276, and in the barrel forward of the projectile by way of by-pass slot 354 in the barrel bore wall, to, e.g., 1000 psi as registered on a suitable pressure gauge 348 communicating with the accumulator chamber. The valve is then shut off, the launcher aimed, and the lanyard 344 jerked to extract the firing pin and release the cap and projectile.

Referring to FIGS. 13-19, trolley or pulley line anchor type of projectile 180 is shown and is preferably manufactured in three separate components, the tip 182, the body 184, and the trolley line pack generally designated 186, and is made preferably of steel and/or fiberglass composite. The tip is replaceable or inter changeable with other type tips by means of threaded stud 187 or equivalent means and the whole projectile can be salvaged, inspected and reused. It is typically made with a 9 7/8 inch or 7⅞ inch outside diameter and lengths of 22 or 25 inches. The body is machined or cast with two 1-inch wide by 1/16 inch deep grooves 188 around the outside for leather or plastic or the like sliding seals 190. The body inner wall 191 has two lengthwise grooves 192, 194 into which the pedestal or pulley retainer plate 196 of the trolley line pack is slidably inserted. An annular groove 198 is located in the body inner wall at the back of the projectile for receiving a retaining ring 200. This retaining ring and a plastic or metal disc 202 holds the coiled or packed line in place within the projectile for a sufficient distance from the barrel to prevent entanglement thereof, particularly of small line. Spaced apertures 204, 206 through which the half segments 208, 210 of the pulley line 211 loosely feeds assists in preventing entanglement. The trolley line pack is provided with a 2½ inch diameter pulley wheel 212 that is rotatably mounted on shaft 214 which may be press fitted in socket 216 in plate 196 which divides the line 211 in halves. This dividing plate allows for smooth and even release of the line when the projectile is fired. Apertures 218 may be provided in plate 196 to allow it to be staked or tied any convenient manner to the landing site.

This anchor projectile is designed to enable the operator to attach heavy lines, to the tethered ends of the small line such that when the heavy line is pulled through the pulley, heavy equipment can be transported to the landing site.

Figure 18:
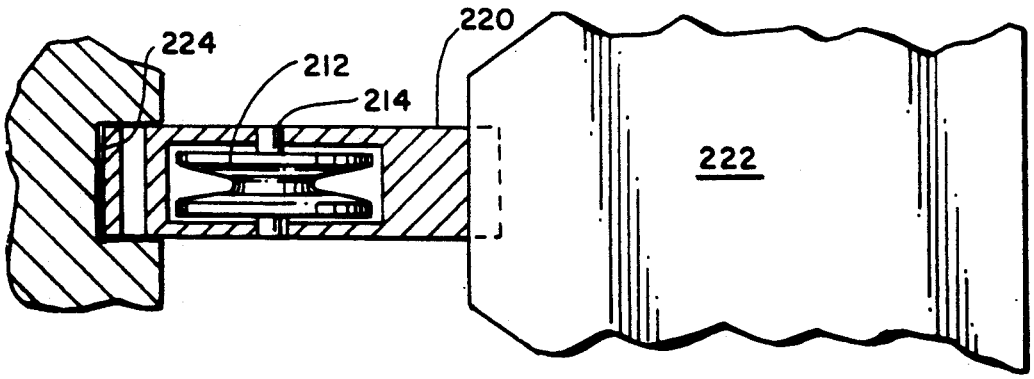
FIG. 18 is a partially cross-sectional view of a disassembleable variation of the retainer plate and pulley assembly.
Figure 19:
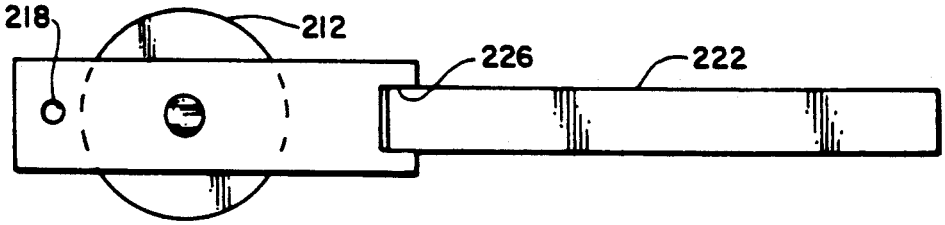
FIG. 19 is a side or edge view of the assembly of FIG. 18.
Figure 20:
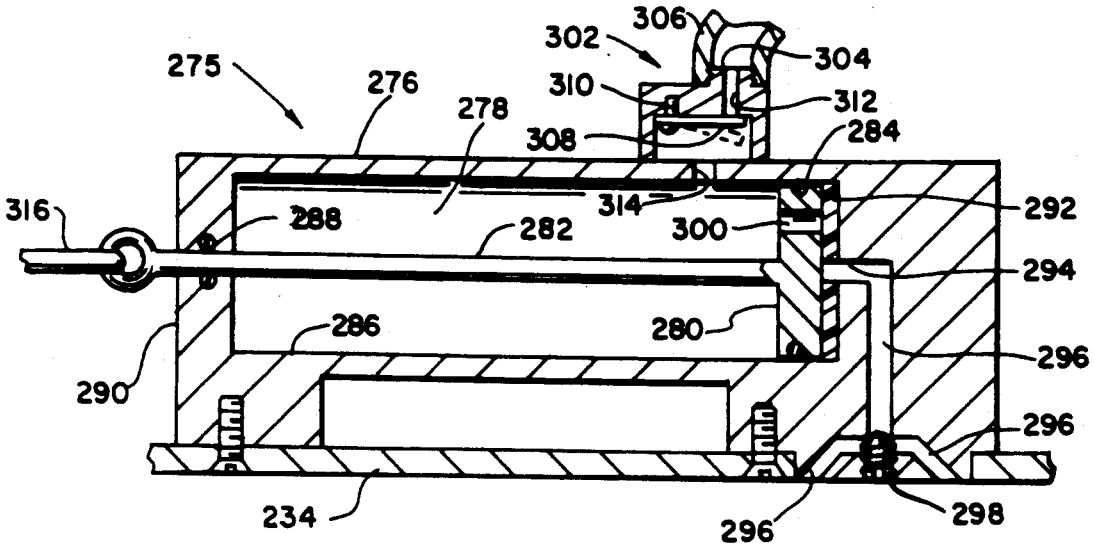
FIG. 20 is an enlarged cross-sectional view of the bleed valve, air brake of the unit of FIG. 12.

Referring to FIGS. 18 and 19, a variation of the pulley arrangement is shown wherein the pulley wheel 212 is mounted in a somewhat conventional type pulley body 220 such that it can be more conveniently disassembled from the divider plate 222 which is basically the equivalent of plate 196. Upon removal and connected by rope or cable or other means passed through aperture 218 to a tree, rock or other terrestrial fixture. In this embodiment bearing 220 is slidably fitted into cavity 224 in the projectile body 184, and is provided with a slot 226 slidably receiving the forward edge of plate 222. In this manner since the plate is stabilized in grooves 192, 194, the pulley is stabilized until plate 222 is removed.

The anchor type projectiles described above and in FIG. 26 are designed to be loaded with enough relatively light nylon or Kevlar line on each side of the pulley retainer plate to reach across a mine field, for example, or to the exact distance desired by the party clearing the area to be cleared. Each end of that line is then attached to an anchor cable that is attached to the braking system inside of the launcher so that at the point where the projectile reaches the end of the line on both sides of the pulley, the projectile suspended momentarily in mid-air, and then falls to the ground exactly at the point predetermined by the operator firing the projectile.

Figure 26:
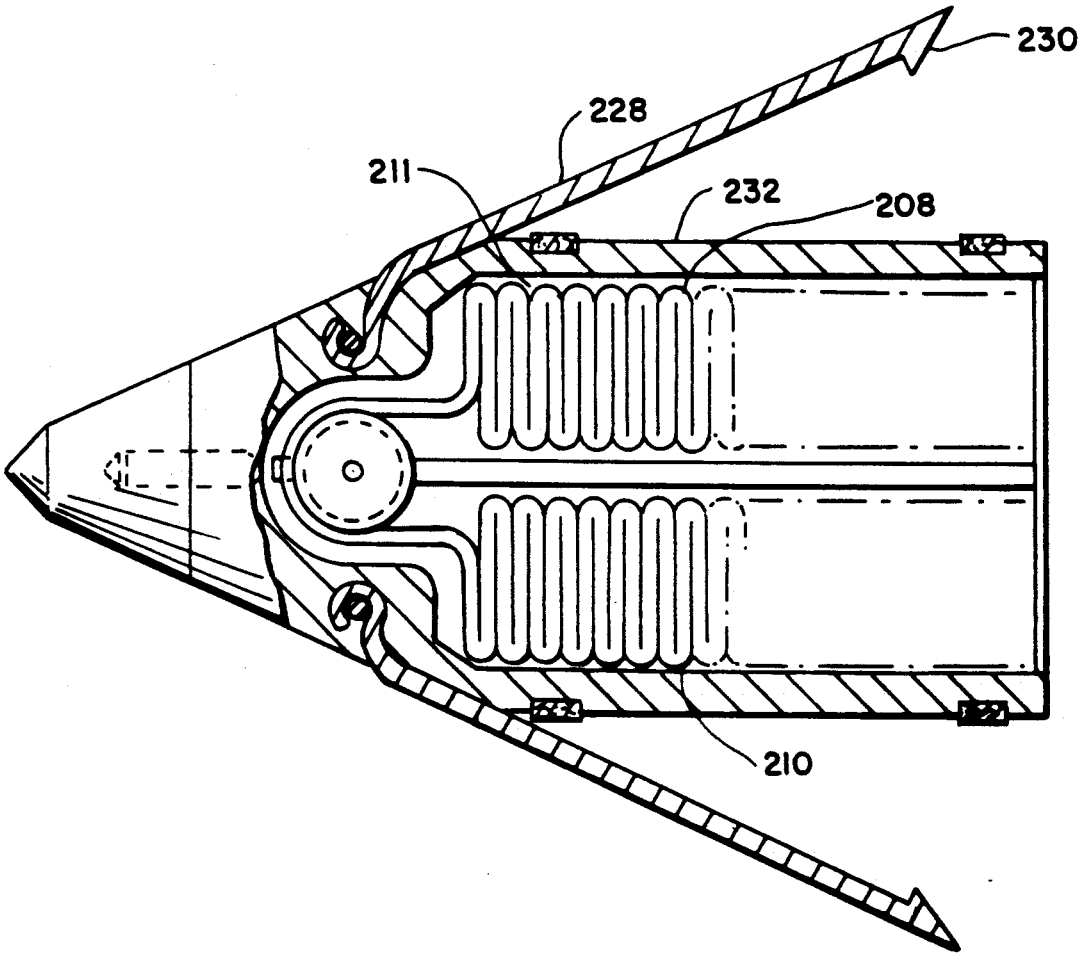
FIG. 26 is a variation of the embodiment of FIG. 13 provided with openable grappling prongs.

With reference to FIG. 26, as the anchor projectile leaves the barrel of the launcher, a plurality of, spring loaded rods 228 preferably with barbs 320 at their ends spring out of grooves 232 cut into the outside of the projectile casing. In their operative position they form an angle a shown with the tail of the projectile so that as the projectile hits the ground and is pulled back slightly, one or more of the barbed rods dig into the ground or become hung up on rocks or trees in a fashion similar to an anchor on a ship or a grappling hook, firmly securing the projectile at that point so that the pulley system can then be utilized to pull heavier line through the pulley, if desired or to immediately transport equipment, explosive cord, or other materials.

When using the pulley projectile for mine clearing, while several different methods may be used, one example is that the lines are fired across a field and anchored. An extruded plastic explosive made in the form of rods, strips, or rope such as "Detcord" can then be pulled across the field to the projectile from a reel that would be located separately from the truck carrying the launcher until it is pulled close to the anchored projectile. Tension is maintained at all times on the extruded explosive material being pulled across the field and on the pull line so as to keep both of them off of the field to the greatest extent possible. After the explosive material is pulled all the way across the field, it and the pull line are staked down on the near side to continue to keep tension on them and keep them off the field until such time as they are ready to be lowered into place for detonation. It is noted that the rear of the anchored projectile will be several inches above the ground when the line is under tension.

The same procedure is repeated at spaced points along the entire length of the field. When all of the cords have been put in place, they can be drawn tight and lowered to a position approximately five inches above the field where they would be staked and then joined together by a detonating cord. When they are all tied together, all of the explosives so laid across can be detonated at a point about five inches above the ground setting off a sufficient explosive force to detonate all of the mines in the field.

Other uses for the same grappling hook-anchor pulley system include: laying down defensive perimeters around exposed military units; cutting lines through concentena wire; clearing beaches ahead of landing craft; getting rescue equipment to personnel stranded in inaccessible area such as high rise buildings, cliff faces, flooded streams, or the like; cutting power or pipe lines or getting construction equipment across impassible streams, rivers, gullies or canyons; and for piercing building walls such that the hooks spring out after passing therethrough and anchor the projectile within the building such that hoses, equipment or the like can be transported to the building.

The invention has been described in detail with particular reference to preferred embodiments thereof, but it will be understood that variations and modifications will be effected within the spirit and scope of the invention.

Figure 23:
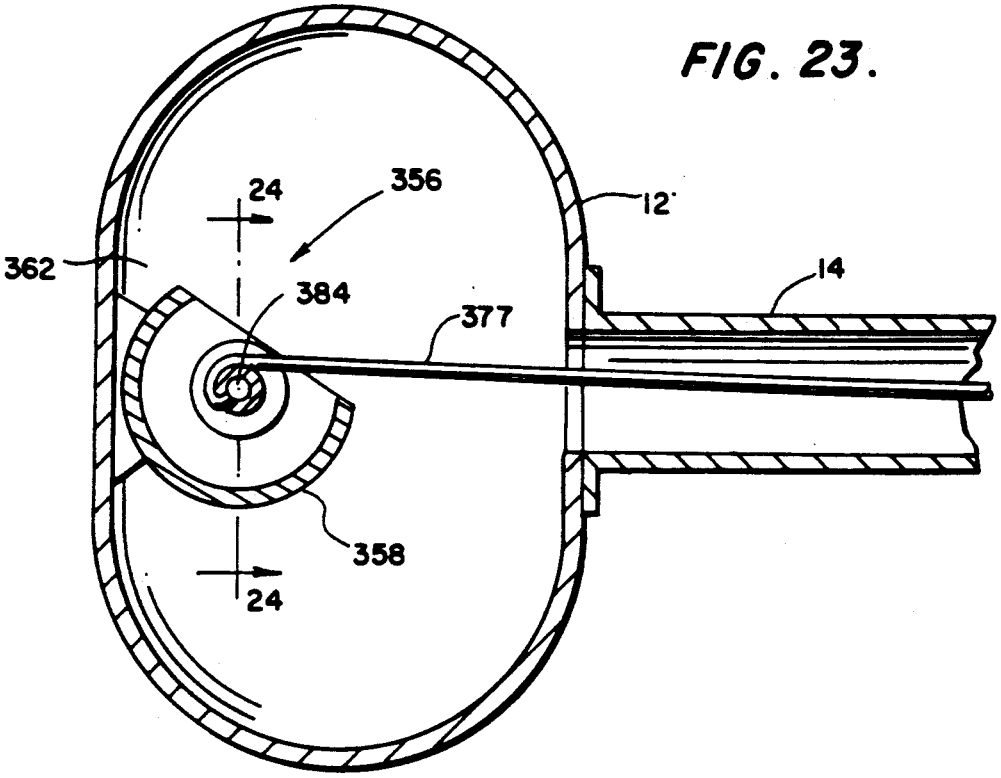
FIG. 23 is a cross-sectional side view of an embodiment of the present transport unit provided with a combination tether retracting device and line braking system.
Figure 24:
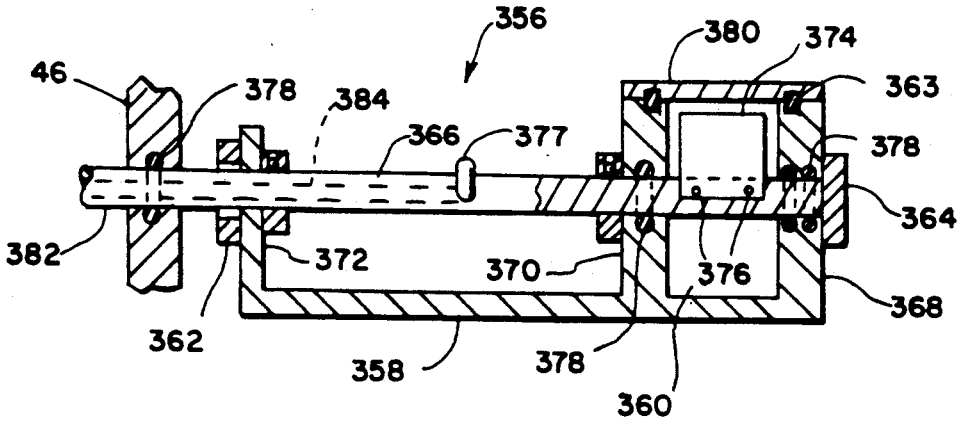
FIG. 24 is a cross-sectional view taken along line 24—24 of FIG. 23 in the direction of the arrows and showing the reel drum and hydraulic braking mechanism thereof, with the line near its full extension.
Figure 25:
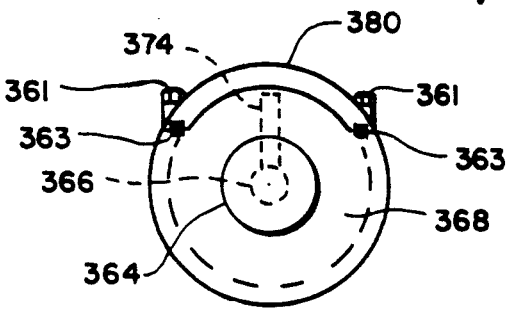
FIG. 25 is an end view of FIG. 24 taken in the direction of the arrow.

Referring to FIGS. 23 and 24, a hydraulic braking and tether retracting device generally designated 356 is shown to illustrate how a line packed projectile can be attached to a permanent tether and loaded through an attached barrel end. The device 356 is shown installed in a launcher tank 12 such as shown in FIG. 1 and comprising a shell 358 having at least one sealed chamber 360. This shell is welded or the like to brackets 362, 364 welded to the tank wall. A shaft 366 is rotatably mounted through walls 368, 370, and 372 of the shell and through end dome 46 of the launcher tank 12. A substantially flat paddle 374 is affixed in a slot in the shaft by pins 376 or the like and is rotatable with the shaft around chamber 360. A tether line 377 is affixed to the shaft such that it is wound up thereon or wound off as the shaft is rotated. Chamber 360 which is of annular configuration such that as paddle 374 rotates therearound the spacing of the edges of the paddle and the walls of the chamber is maintained substantially constant. The chamber is filled with any hydraulic fluid such as automotive transmission fluid. Suitable sealing means such as O-ring seals 378 seal chamber 360 against fluid leakage and tank 12 against gas leakage. The dimensions of this device, including the paddle spacing can be varied as required to give the desired braking effect. A removable cover plate 380 for chamber 360 secured by suitable bolts 361 or the like to walls 368, 370 and sealed by 363 provided access thereto for paddle assembly and hydraulic fluid filling.

The exterior end 382 of shaft 366 can be affixed to any suitable cranking means, manual or automatic for rewinding the tether line 362 thereon after attachment to a repacked projectile line. In this manner, the repacked projectile may be inserted into the barrel end and pushed therein to a desired depth while the tether line is being rewound on the shaft. In this manner, kinking or tangling of the lines within the launcher are prevented.

Variations of such hydraulic braking device include providing a fluid passage in shaft 366 such as 384 to which a fluid carrying line or tether 362 in the forms of a strong, fluid carrying hose is connected for receiving pressurized fluid such as fire extinguishant from an external source connected to the exterior end of the shaft and fluid passage by suitable coupling means.

In regard to other types of braking devices which can be employed to give a desired deceleration profile, included are the mechanical drum or disc typed as employed on automobiles, or electrical type brakes as used on auto towed trailers and the like. Such brakes can be manually or automatically controlled by electronic sighting means which can visually determined when and with what force the projectile should be decelerated.

The invention has been described in detail with particular reference to preferred embodiments thereof, but it will be understood that variations and modifications will be effected within the spirit and scope of the invention.

I claim:

1. A transport unit comprising projectile launching means having barrel means, removable cap means mounted on said barrel means end comprising means for moving said cap means to and from a position sealing the open end of said barrel means, projectile means, said barrel means comprising means for receiving said projectile means braking means on said launching means, and line means connected at one end to said projectile means and at its other end to said braking means, said launching means having a compressed gas chamber and means for placing said compressed gas chamber in pressure communication with said barrel means and said projectile means, said compressed gas chamber comprising means for providing launching force to said projectile means upon actuation of said launching means by removal of said cap means from its sealing position on said barrel end, said braking means comprising means for beginning deceleration of said line means prior to the full extension thereof.

2. The unit of claim 1 wherein at least a major length of line means is coiled or packed within said projectile means prior to launching thereof.

3. The unit of claim 1 wherein said braking means comprising means for engaging said line means and decelerating the line means at a predetermined extension thereof.

4. The unit of claim 1 wherein said chamber contains air at between about 10 and about 5,000 psi.

5. The unit of claim 1 wherein said braking means is of a hydraulic fluid resistance type.

6. The unit of claim 1 wherein said line means comprises a line and pulley assembly mounted in said projectile means.

7. The unit of claim 1 wherein said projectile means is provided with anchoring prong means.

8. The unit of claim 1 wherein said launching means comprises tank means providing said compressed gas chamber, and said barrel means is mounted thereon in fluid communication with the interior thereof.

9. The unit of claim 8 wherein a trailing portion of said line means proximate its other end is contained within said tank means, and wherein said braking means is provided within said tank means for engaging said trailing portion for decelerating said line means at a predetermined extension thereof.

10. The unit of claim 9 wherein said braking means comprises a friction applying, motion resistance mechanism.

11. The unit of claim 9 wherein said braking means comprises a combination of a friction applying and a spring powered, motion retarding mechanism.

12. The unit of claim 9 wherein said braking means comprises a spring powered, motion resistance mechanism.

13. The unit of claim 12 wherein said braking means comprises a coiled tension spring affixed at one end to said trailing portion and affixed at its other end at a position displaced from said portion, said spring normally causing deflection of said trailing portion and resisting straightening thereof.

14. The unit of claim 9 wherein said braking means comprises stationary guide means mounted in said tank means adjacent to and substantially in alignment with a bore axis of said barrel means said line means is a hose means, the other end of said line means being substantially fixed in position within said tank means, movable guide means mounted in said tank means in a position non-aligned with said axis, motion resistance means mounted in said tank means engaging said movable guide means and comprising means for progressively increasing the resistance to motion of said movable guide means in proportion to the extent of motion thereof, said hose means forcibly engaging said stationary and movable guide means during said deceleration.

15. The unit of claim 14 wherein said motion resistance means comprises friction mean which provides progressively greater resistance to motion as said movable guide means moves toward alignment with said axis.

16. The unit of claim 14 wherein said movable guide means comprises a plurality of opposed movable guide means.

17. The unit of claim 16 wherein said motion resistance means comprises friction means having bearing means spring urged into frictional contact with each of said movable guide means and resisting motion thereof.

18. The unit of claim 14 wherein said motion resistance means comprises friction means having bearing means spring urged into frictional contact with said movable guide means and resisting motion thereof.

19. The unit of claim 18 wherein said movable guide means comprises roller means and wherein said bearing means engages end portions thereof.

20. A fluid transport unit having projectile launching means comprising tank means providing a compressed gas chamber, barrel means mounted on said tank means and being in communication with the interior thereof for being pressurized thereby said barrel means having an exit end, projectile means positioned in said barrel means, line means comprising hose means connected at one end to said projectile means, and means for connecting said hose means at its other end to a pressurized source of fluid, said line means being provided with said fluid and being by said projectile means, said compressed gas chamber comprising means for providing launching force to said projectile means upon actuation of said launching means.

21. The unit of claim 20 wherein pressure sealing, cap means is provided on the exit end of said barrel means, cooperating releasable lock means on said cap means and said barrel means, launch actuating means comprising means for releasing said cap means from a locked position on said barrel means, said projectile means is positioned in said barrel means with respect to said cap means to provide a pre-exit cell therebetween, and a compressed gas source in fluid communication with said cell of sufficient pressure to maintain said projectile means a substantial distance from said cap means, the gas pressure of said cell comprising means for forcing said cap means clear of an exit path of said projectile means upon release of said cap means from its locked position.

22. The unit of claim 21 wherein a trailing portion of said hose means proximate its other end is contained within said tank means, and wherein braking means is provided within said tank means for engaging said trailing portion for decelerating said hose means proximate the limit of its extension.

23. The unit of claim 22 wherein said braking means comprises stationary guide means mounted in said tank means adjacent to and substantially in alignment with a bore axis of said barrel means, the other end of said hose means being substantially fixed in position within said tank means, movable guide means mounted in said tank means in a position non-aligned with said axis, motion resistance means mounted in said tank means engaging said movable guide means and comprising means for progressively increasing the resistance to motion of said movable guide means in proportion to the extent of motion thereof, said hose means forcibly engaging said stationary and movable guide means during said deceleration.

24. The unit of any one of claims 1–7 wherein said line means contains explosive material.

* * * * *